US006881908B2

(12) United States Patent
Oikawa

(10) Patent No.: US 6,881,908 B2
(45) Date of Patent: Apr. 19, 2005

(54) FLEXIBLY DESIGNABLE KEYBOARD AND A METHOD OF PRODUCING THE SAME

(75) Inventor: Hiroaki Oikawa, Ichikawa (JP)

(73) Assignee: Elcom Corporation, Chiba (JP)

( * ) Notice: Subject to any disclaimer, the term of this patent is extended or adjusted under 35 U.S.C. 154(b) by 258 days.

(21) Appl. No.: 10/051,084

(22) Filed: Jan. 22, 2002

(65) Prior Publication Data

US 2002/0097171 A1 Jul. 25, 2002

(30) Foreign Application Priority Data

Jan. 23, 2001 (JP) ..... 2001-014415

(51) Int. Cl.[7] ..... H01H 9/00
(52) U.S. Cl. ..... 200/5 A; 200/17; 200/6 A
(58) Field of Search ..... 200/5 A, 5 R, 200/6 A, 17, 18

(56) References Cited

U.S. PATENT DOCUMENTS 4,211,497 A * 7/1980 Montgomery ..... 400/486
4,246,452 A * 1/1981 Chandler ..... 200/5 A
4,609,792 A * 9/1986 Levasseur ..... 200/5 A
4,616,213 A * 10/1986 Danish ..... 341/21
4,667,181 A * 5/1987 Hastreiter ..... 341/26
4,712,092 A * 12/1987 Boldridge et al. ..... 341/34
4,763,782 A * 8/1988 Sinchok ..... 206/708
5,712,661 A * 1/1998 Jaeger ..... 345/170
6,171,115 B1 * 1/2001 Mickievicz et al. ..... 439/76.1

FOREIGN PATENT DOCUMENTS

JP 59-221736 A 12/1984
JP 11-017367 1/1999

* cited by examiner

*Primary Examiner*—Kyung Lee
(74) *Attorney, Agent, or Firm*—Birch, Stewart, Kolasch & Birch, LLP

(57) ABSTRACT

A keyboard of the present invention satisfies any desired specifications, i.e., a desired number and a desired arrangement of key switches. A switch circuit board and frame members are respectively cut away from a large, original frame material and an elongate, original frame material in accordance with the desired arrangement of key switches. The keyboard can therefore be produced by a minimum number of designing and producing steps. Moreover, it is not necessary to prepare many different kinds of parts beforehand. The keyboard is particularly suitable for many kinds, small quantity production that produces keyboards with different specifications to order.

14 Claims, 4 Drawing Sheets

FLEXIBLY DESIGNABLE KEYBOARD AND A METHOD OF PRODUCING THE SAME

BACKGROUND OF THE INVENTION

1. Field of the Invention

The present invention relates to a keyboard, more particularly to a keyboard advantageously applicable to a computer, POS (Point Of Sales) terminal, automatic control system or similar processor system, and a method of producing the same.

2. Description of the Background Art

Processing systems of the kind applying computers use various kinds of keyboards as man-machine interfaces. A POS terminal and an automatic control system, for example, use a keyboard matching with functions particular thereto. That is intended to allow such a dedicated keyboard to enter desired commands and data particular to the functions of the POS terminal or those of the automatic control system more efficiently than a general purpose keyboard. The dedicated keyboard therefore includes keys laid out specifically to the functions of a processing system.

Those keys are of course provided specifically to an individual processing system and raid out appropriately for an easy manipulation. More specifically, the keys are positioned at lattice points formed on X-Y coordinates. The keyboard includes an encoder for converting lattice points of keys on the coordinates to corresponding code signals.

When a POS terminal or an automatic control system is designed, a keyboard is designed and manufactured which has the number and layout of keys dedicated to the terminal or the system. To an encoder, which generally includes a ROM (Read-Only Memory), an encoder program particular to the terminal or the system is written in at the production stage of the keyboard.

A keyboard is made up of various structural parts including key tops or a key sheet, key switches, a switch circuit board, an encoder circuit board, and a frame. The switch circuit board has an X-Y matrix circuit printed thereon which is associated with the key switches. On the encoder circuit board, mounted is an encoder. The frame includes a switch panel on which the key switches are mounted. Users always demand a variety of processor systems. To meet users' demands for such various processor systems, a variety of keyboards must be designed and produced which have a corresponding variety of key layouts under particular demands, indeed. Particularly, the switch circuit board and frame must be designed and produced in accordance with the specifications of a processor system required by the individual user. The conventional keyboard therefore needs a great number of designing and producing works. This requires many different kinds of parts to be stocked and the lead time of delivery to be extended accordingly, thus increasing the cost of the keyboard.

SUMMARY OF THE INVENTION

It is an object of the present invention to provide a keyboard that can be produced by a minimum number of designing and manufacturing works and makes it needless for a manufacturer to prepare many kinds of parts beforehand.

A keyboard of the present invention includes a plurality of key switches arranged in a matrix and each including a respective contact. A first circuit board has a plurality of first circuit patterns connecting one terminals of the contacts of the key switches to each other in a first direction of the matrix, and a plurality of second circuit patterns connecting the other terminals of the contacts to each other in a second direction of the matrix. The first circuit patterns and second circuit patterns intersect each other. An encoder circuit for generating codes representative of the statuses of the key switches is mounted a second circuit board. A first flat cable has a plurality of conductors each being connected to one of the first circuit patterns, and a flat, flexible insulator covering the conductors. A second flat cable has a plurality of conductors each being connected to one of the second circuit patterns, and a flat, flexible insulator covering the conductors. The second circuit board includes a first connector connecting the first flat cable to the encoder circuit and a second connector connecting the second flat cable to the encoder circuit.

Also, a method of producing a keyboard of the present invention begins with a step of preparing a first circuit board. The first circuit board includes a plurality of first circuit patterns connecting one terminals of the contacts of a plurality of first key switches, which are arranged in a matrix, to each other in a first direction of the matrix, and a plurality of second circuit patterns connecting the other terminals of the contacts to each other in a second direction of the matrix. The first circuit patterns and second circuit patterns intersect each other. A plurality of second key switches smaller in number than the second key switches are prepared. Subsequently, the first circuit board is sliced to thereby produce a portion corresponding to the second key switches. A second circuit board is prepared on which an encoder for generating codes representative of the statuses of the second key switches is mounted. Each of a plurality of conductors, which are included in a first flat cable and covered with a flat, flexible insulator, is connected to one of the first circuit patterns. A plurality of conductors, which are included in a second flat cable and covered with a flat, flexible insulator, each are connected to one of the second circuit patterns. The first flat cable and second flat cable are connected to a first connector and a second connector, respectively, connected to the encoder circuit. The contacts of the second key switches are connected to the first circuit patterns and second circuit patterns included in the portion cut away from the first circuit board.

BRIEF DESCRIPTION OF THE DRAWINGS

The objects and features of the present invention will become more apparent from consideration of the following detailed description taken in conjunction with the accompanying drawings in which.

DESCRIPTION OF THE PREFERRED EMBODIMENT

Figure 1:
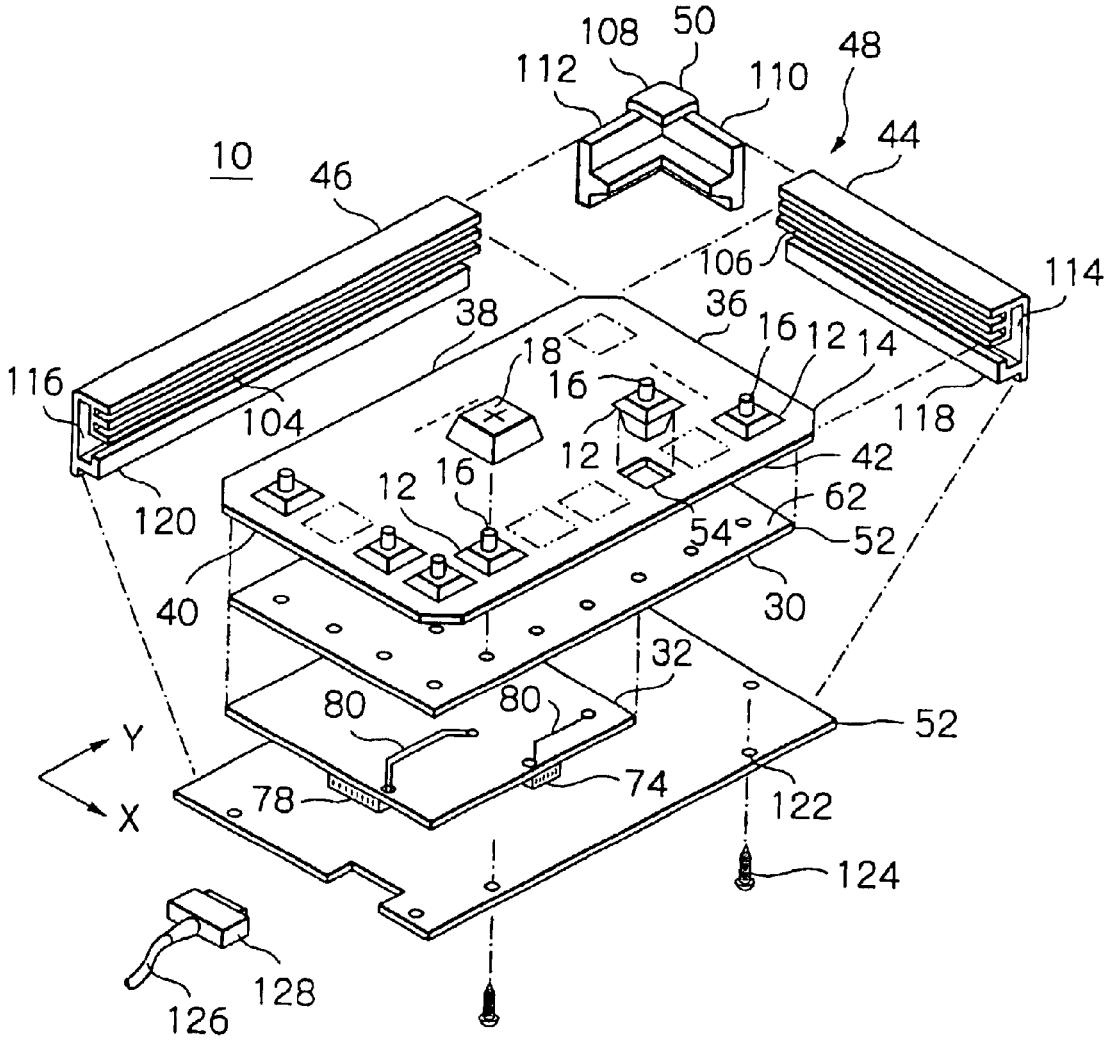
FIG. 1 is an exploded perspective view showing a preferred embodiment of a keyboard in accordance with the present invention.

Referring to FIG. 1 of the drawings, a preferred embodiment of a keyboard 10 in accordance with the present invention is advantageously applicable to a computer, POS terminal, automatic control apparatus or similar processor system. As shown, with the specific embodiment, the keyboard, generally 10, includes twenty-eight key switches 12 arranged in four rows in the direction X and seven columns in the direction Y to form a matrix on rectangular coordinates. The key switches 12 are affixed to a switch panel 14. If desired, the switch panel 14 may be omitted. In such a case, the key switches 12 may be directly affixed to a switch circuit board 28 without the intermediary of the switch panel 14. Of course, the number and arrangement of the key switches 12 shown in FIG. 1 are only illustrative. Only several key switches 12 are shown in FIG. 1 for avoiding complexity. This is also true with the other structural elements to be described hereinafter.

Figure 5:
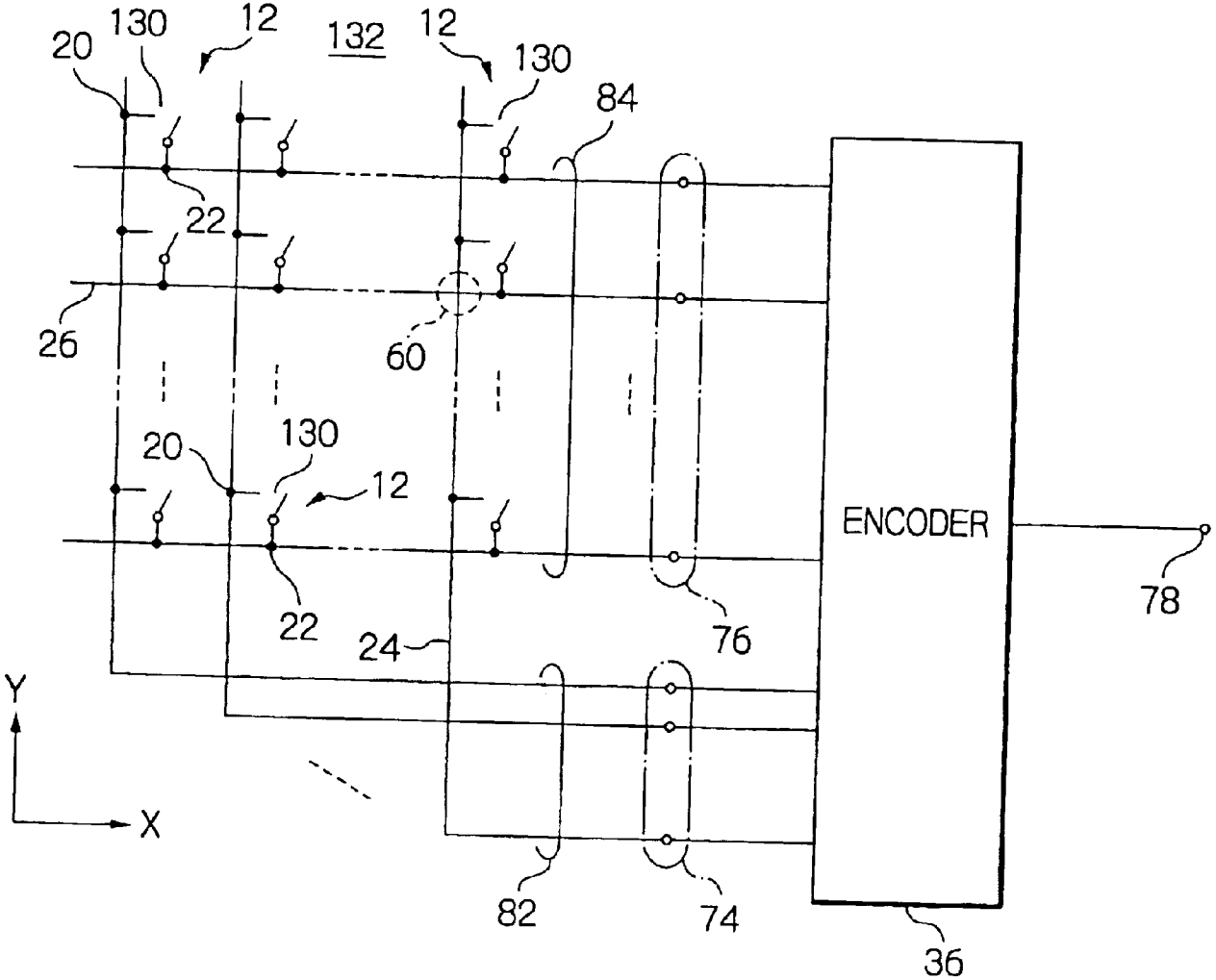
FIG. 5 is a schematic circuit diagram showing a specific circuit configuration of the illustrative embodiment.

From the center of each key switch 12, a rod 16 protrudes upward, which is movable in the up-and-down, or longitudinal, direction thereof. Over the rods 16, coupled are key tops 18. The key tops 18 may be replaced with a key sheet, not shown, if desired. The key switch 12 accommodates a contact 130, FIG. 5, thereinside. The rod 16 causes the contact 130 to close when moved downward. The contact 130 is connected to terminals 20 and 22, FIG. 2, that are, in turn, soldered to X-Y matrix circuit patterns 24 and 26, FIG. 3, respectively. In the rod 16, an LED (Light Emitting Diode), not shown, may be positioned, if desired. The X-Y matrix patterns 24 and 26 are printed on one major surface 30 of the switch circuit board 28. The switch circuit board 28 is affixed to the switch panel 14 by soldering mentioned above.

Figure 2:
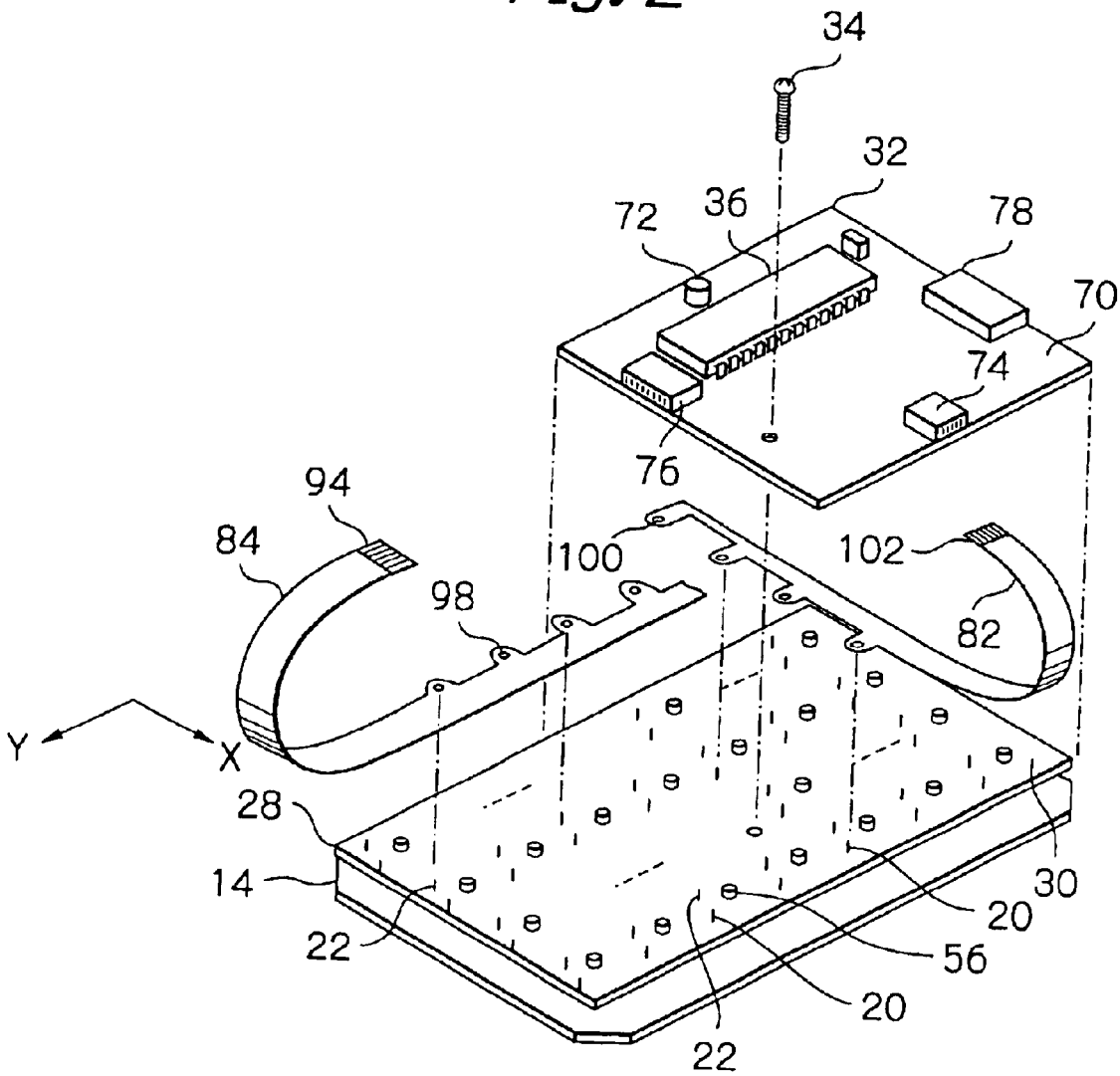
FIG. 2 is an exploded perspective view showing the illustrative embodiment as seen from the bottom in the condition shown in FIG. 1.

As shown in FIG. 2, the switch circuit board 28 has an encoder circuit board 32 affixed thereto by a screw 34. The encoder circuit board 32 is a printed circuit board on which various electronics devices are mounted such as an encoder electronics 36 in the form of IC (Integrated Circuit). In practice, the encoder circuit board 32 is affixed to the switch circuit board 28 by four screws 34 although not shown specifically. Of course, five or more screws 34 or any other suitable affixing means, e.g., fasteners may be used for affixing the encoder circuit board 32 to the switch circuit board 28.

The switch panel 14 has a generally rectangular, flat configuration having four sides 36, 38, 40 and 42. The sides 36 and 38, for example, are respectively received in and supported by frame members 44 and 46, which form part of a generally rectangular frame 48. The rectangular frame 48, only part of which is shown in FIG. 1, has corner members 50, one of which shown in the figure connects the frame members 44 and 46 to each other. The other sides 40 and 42 of the switch panel 14 are supported by other frame members, not shown, which form the other part of the frame 48, in the same manner as the sides 36 and 38. The bottom of the resulting assembly, as viewed in FIG. 1, is closed with a panel 52 by mounting the panel 52 from the bottom to complete the keyboard assembly 10. In the illustrative embodiment, the switch panel 14 is formed of aluminum and formed with generally rectangular holes 54. The key switches 12 each are received in one of the holes 54. The key switches 12 have center lugs 56, FIG. 2, protruding from the bottom thereof opposite to the top where the rods 61 are positioned, as viewed in FIG. 1.

Figure 3:
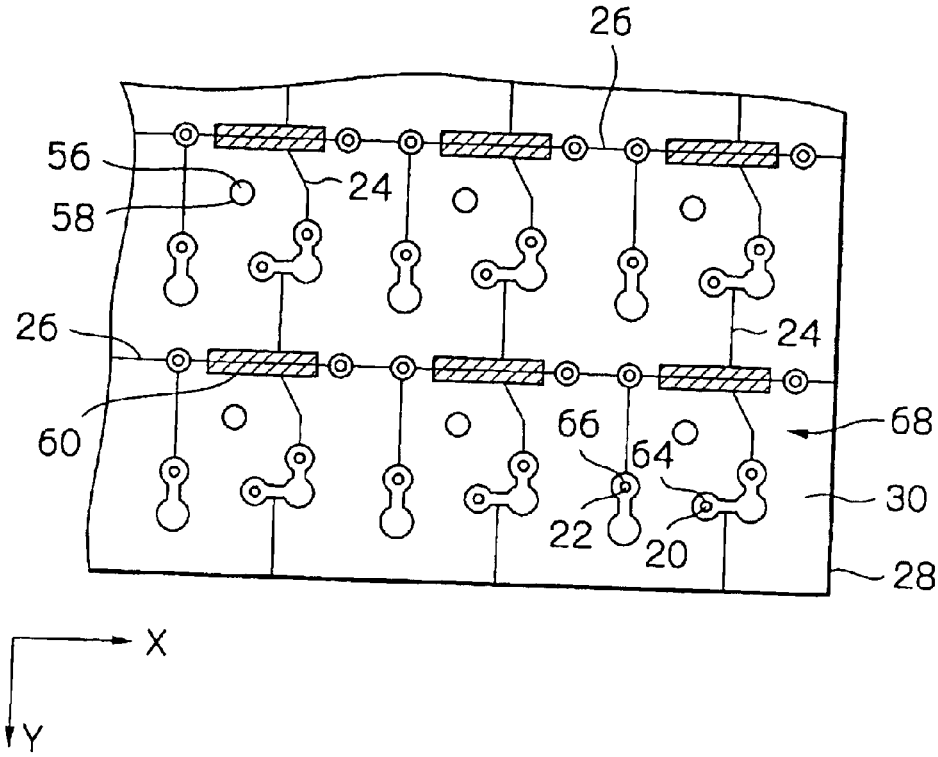
FIG. 3 is a fragmentary plan view of a switch circuit board included in the illustrative embodiment, as seen from the top of FIG. 2.

The switch circuit board 28 is implemented as a generally rectangular, flat board slightly smaller in size than the switch panel 14 and formed of synthetic resin such as epoxy resin. As shown in FIG. 3, the switch circuit board 28 is formed with circular holes 58 corresponding in position to the center lugs 56 of the key switches 12. The center lugs 56 each are received in one of the holes 58, thereby positioning the associated key switch 12 relative to the switch circuit board 28.

The switches 12 are laid out in the form of lattice on the X-Y coordinate. As seen from FIG. 3, the switch circuit board 28 has the circuit patterns 24 and 26 printed on one major surface 30 thereof, i.e. the surface opposite to the other major surface 62, FIG. 1, which adjoins the key switches 12. The circuit patterns 24 and 26 are formed of copper and constitute, an X-Y matrix pattern of circuit 132, FIG. 5. The circuit patterns 24 connect the terminals 22 of the key switches 12 in the direction Y. The circuit patterns 26 connect the other terminals 20 of the key switches 12 in the direction X. The switch circuit board 28 is formed with holes 64 and 66. The terminals 20 and 22 of each key switch 12 respectively extend from one major surface 62 of the switch circuit board 28 throughout the holes 64 and 66, protruding from the other major surface 30. The tips of the terminals 20 and 22 protruding from the major surface 30 are respectively soldered to and therefore electrically connected to the circuit patterns 24 and 26. The circuit patterns or wirings 24 and 26 intersect each other at carbon jumper portions 60 formed on the major surface 30. The carbon jumper portions 60 electrically insulate the circuit patterns 24 and 26 from each other. The contacts 130 of the key switches 12 are thus interconnected in the form of matrix.

In the configuration described above, it is clearly seen that the circuit patterns 24 and 26 constitute part of unit switch circuits 68, which are equal in number and correspond to the key switches 12 mounted thereon. Each of the unit switch circuits 68 is assigned to one of the key switches 12, and includes one circular hole 58, one carbon jumper portion 60, and joint holes 64 and 66 in addition to the circuit patterns 24 and 26.

Specifically, it is noteworthy with the illustrative embodiment that an original, or mother, switch circuit board, not shown, is first formed with a great number of unit switch circuits 68 and then sliced to produce a desired size of switch circuit board 28 in accordance with specifications for the specific design of required keyboard 10. The specifications include the number and arrangement of key switches 12. More specifically, the manufacturer of the keyboard 10 prepares a larger, original, or raw, switch circuit board formed with a great number of unit switch circuits 68 in, e.g., a 100×120 matrix. The manufacturer then cuts off part of the original switch circuit board that corresponds to, e.g., the 4×7 unit switch circuits 68 of the illustrative embodiment, thereby producing the switch circuit board 28. It therefore suffices to design and prepare a single kind of large, original switch circuit boards without regard to specifications required of the individual keyboard 10.

The coordinates position particular to each of the key switches 12 in the X-Y matrix is converted to a particular code by the encoder electronics 36 carried on the encoder circuit board 32. As shown in FIG. 2, the encoder electronics 36, mounted on one major surface 70 of the encoder circuit board 32, generates a code representative of the open/closed status of the contact 130 of the individual key switch 12. The encoder electronics 36 includes a memory, not shown, for storing encoder program sequences for generating code signals in accordance with the layout of keys that matches with required specifications. The memory may advantageously be implemented as a ROM.

The encoder circuit board 32 is also implemented as a generally rectangular plate formed of, e.g., epoxy resin. In the illustrative embodiment, the encoder circuit board 32 has a smaller size than the switch circuit board 28. The one and the other major surfaces 70 and 72 of the encoder circuit board 32 have a copper wiring printed thereon such as shown with a reference numeral 80 in FIG. 1, thereby interconnecting the encoder electronics 36, an electronic device 72, and connectors 74 and 76 by way of example.

Figure 4:
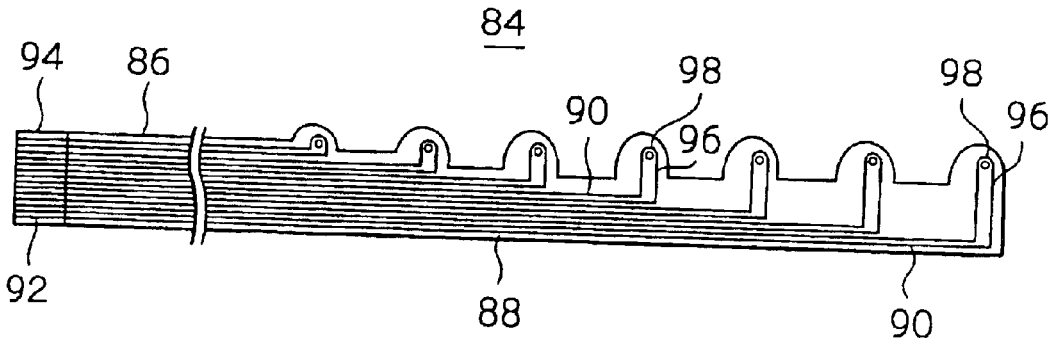
FIG. 4 is a plan view showing a specific configuration of a flat cable also included in the illustrative embodiment.

One 74 of those connectors is connected to the circuit pattern 24 of the switch circuit board 28 by a flat cable 82. Likewise, the other connector 76 is connected to the other circuit pattern 26 by a flat cable 84. As shown in FIG. 4, taking up the flat cable 84 as an example, it has a protection sheet formed by an elongate, flexible member 86, which is made of PET (polyethylene terephthalate) in the illustrative embodiment. The protection sheet 86 has an array of flat conductors 88, e.g., copper foils thereinside. In the illustrative embodiment, the array comprises seven conductor strips 88 corresponding in number to the key switches 12, which are arranged in the direction Y, and generally configured in the form of a letter L each. More specifically, each conductor 88 has two arms 90 and 96 generally perpendicular to each other. The arm 90 has a far end 92 exposed to the outside of the flexible member 86, constituting a connector portion 94. Likewise, the other arm 96 has a far end exposed to the outside of the flexible member 86, constituting a connecting portion 98 to be connected to the terminals 22.

As shown in FIG. 2, the flat cable 84 with the configuration described above is first positioned on one major surface 30 of the switch circuit board 28. The connector portions 98 are then soldered to the terminals 22. Subsequently, the connector portions 94 are inserted in the connector 76. As a result, the seven circuit patterns 26 in the direction X are connected to the encoder electronics 36 via the connector 76. Likewise, the other flat cable 82 has connector portions 100 soldered to the terminals 20, and then connector portions 102 are inserted in the connector 74. Consequently, the four circuit patterns 24 in the direction Y are connected to the encoder electronics 36 via the connector 74. In this manner, the contacts of all key switches 12 are electrically connected to the encoder electronics 36.

Further, the illustrative embodiment is characterized in that the frame members 44 and 46 are cut away from a longer, original, or mother, frame material, not shown, in accordance with the desired specifications of the specific keyboard 10, e.g., the desired number and arrangement of the key switches 12. More specifically, the manufacturer can produce a necessary number of frame members 44 and 46 having a necessary length each by slicing the original frame material in accordance with the arrangement or layout of the key switches 12 in the directions X and Y. It follows that single kind of elongate, original frame materials should only be designed and produced without regard to specifications required of the keyboard 10.

The frame members 44 and 46 are different from each other in length in the directions X and Y, but identical in cross-section in the directions perpendicular to the directions X and Y. The frame member 46, for example, is formed with a slot 104 extending in the longitudinal direction thereof. One side 38 of the switch panel 14 is inserted in the slot 104. Likewise, the frame member 44 is formed with a slot 106 extending in the longitudinal direction thereof so as to receive another side 36 of the switch panel 14. This is also true with the other sides 40 and 42 of the switch panel 14.

The corner member 50 functions as a joint having a corner portion 108 and two arm portions 110 and 112 extending out from the corner portion 108 perpendicularly to each other. The arm portions 110 and 112 are respectively inserted in other slots 114 and 116 respectively formed in the frame members 44 and 46 in the longitudinal direction thereof. The corner member 50 therefore connects the frame members 44 and 46 substantially at a right angle on a plane formed by the frame members. A corner member, not shown, identical with the corner member 50 is applied to each of the remaining, three corners of the switch panel 14. In this manner, four frame members and four corner members complete the generally rectangular frame 48.

In the ROM, not shown, of the encoder electronics 36, stored are encoder program sequences for generating code signals representative of the open and closed statuses of the contacts 130 of the key switches 12, which are arranged to meet required specifications.

The resultant assembly is finally enclosed by fringing the bottom panel 52 into contact with the bottoms 118 and 120 of the frame members 44 and 46, respectively, as well as to the bottoms of the other frame members. Subsequently, the screws 124 are passed through the holes 122 of the panel 52 to thereby affix the entire assembly. To the output connector 78, an output cable 126 is then jointed by its connector 128, so that the entire keyboard circuit including the encoder electronics 36 is connected to the output cable 126, thus completing the keyboard 10.

In summary, it will be seen that the present invention provides a keyboard capable of satisfying desired specifications, i.e., a desired number and a desired arrangement of key switches. Such a keyboard is achievable only if a switch circuit board and frame members each are cut away from a larger, original frame material or an elongate, original frame material in accordance with the desired specifications for an arrangement of the key switches. The keyboard can therefore be produced by a minimum number of designing and producing works. Moreover, it is not necessary to prepare and store many different kinds of parts beforehand. The keyboard is particularly suitable for many kinds of, but small quantity of production of keyboards with different specifications to order.

The entire disclosure of Japanese patent application No. 2001-014415 filed on Jan. 23, 2001, including the specification, claims, accompanying drawings and abstract of the disclosure is incorporated herein by reference in its entirety.

While the present invention has been described with reference to the particular illustrative embodiment, it is not to be restricted by the embodiment. It is to be appreciated that those skilled in the art can change or modify the embodiment without departing from the scope and spirit of the present invention.

What is claimed is:

1. A keyboard comprising:

a plurality of key switches arranged in a matrix and each including a contact;

a first circuit board having a first plurality of circuit patterns printed thereon to connect one terminals of the contacts of said plurality of key switches to each other in a first direction of the matrix, and a second plurality of circuit patterns printed thereon to connect other terminals of the contacts to each other in a second direction of the matrix, said first plurality of circuit patterns and said second plurality of circuit patterns intersecting each other;

a second circuit board, separate from said first circuit board, carrying an encoder circuit thereon for generating code signals representative of statuses of said plurality of key switches;

a first elongate, flexible flat cable comprising a corresponding plurality of first conductors each being connected to one of said first plurality of circuit patterns, and a flat, flexible insulator covering the plurality of first conductors; and a second elongate, flexible flat cable comprising a corresponding plurality of second conductors each being connected to one of said second plurality of circuit patterns, and a flat, flexible insulator covering the second plurality of conductors;

said second circuit board comprising a first connector connecting said first flat cable to said encoder circuit and a second connector connecting said second flat cable to said encoder circuit.

2. The keyboard in accordance with claim 1, further comprising:

a generally rectangular, flat plate supporting said plurality of key switches;

four elongate frame members each having a slot formed in identical configuration with each other over an entire length of particular one of four sides of said flat plate and each mating with the one side; and four connecting members each connecting two of said four elongate frame members to form a generally rectangular, planar configuration;

said flat plate being supported by said frame members and said connecting members.

3. The keyboard in accordance with claim 2, wherein said second circuit board is supported by said first circuit board.

4. The keyboard in accordance with claim 1, wherein said encoder circuit comprises a memory for storing an encoder program sequence complying with said plurality of key switches.

5. A keyboard comprising:

a plurality of key switches arranged in a matrix and each including a contact;

a first circuit board having a first plurality of circuit patterns printed thereon to connect one terminals of the contacts of said plurality of key switches to each other in a first direction of the matrix, and a second plurality of circuit patterns printed thereon to connect other terminals of the contacts to each other in a second direction of the matrix, said first plurality of circuit patterns and said second plurality of circuit patterns intersecting each other;

a second circuit board carrying an encoder circuit thereon for generating code signals representative of statuses of said plurality of key switches;

a first flat cable comprising a corresponding plurality of first conductors each being connected to one of said first plurality of circuit patterns, and a flat, flexible insulator covering the plurality of first conductors;

a second flat cable comprising a corresponding plurality of second conductors each being connected to one of said second plurality of circuit patterns, and a flat, flexible insulator covering the second plurality of conductors;

said second circuit board comprising a first connector connecting said first flat cable to said encoder circuit and a second connector connecting said second flat cable to said encoder circuit;

a generally rectangular, flat plate supporting said plurality of key switches;

four elongate frame members each having a slot formed in identical configuration with each other over an entire length of particular one of four sides of said flat plate and each mating with the one side; and four connecting members each connecting two of said four elongate frame members to form a generally rectangular, planer configuration;

said flat plate being supported by said frame members and said connecting members.

6. The keyboard in accordance with claim 5, wherein said second circuit board is supported by said first circuit board.

7. The keyboard in accordance with claim 5, wherein said encoder circuit comprises a memory for storing an encoder program sequence complying with said plurality of key switches.

8. A method of producing a keyboard, comprising the steps of:

preparing a first circuit board having a first plurality of circuit patterns printed thereon to connect one terminals of contacts of a first plurality of key switches to be arranged in a matrix to each other in a first direction of the matrix, and a second plurality of circuit patterns printed thereon to connect other terminals of the contacts to each other in a second direction of the matrix, the first plurality of circuit patterns and the second plurality of circuit patterns intersecting each other;

preparing a desired, second plurality of key switches smaller in number than the first plurality of key switches;

slicing the first circuit board to separate a portion of the first circuit board corresponding to the second plurality of key switches;

preparing a second circuit board, separate from the first circuit board, carrying thereon an encoder for generating code signals representative of statuses of the second plurality of key switches;

connecting each of the first plurality of circuit patterns on the separated portion to one of a plurality of conductors which are included in a first elongate, flexible flat cable and covered with a flat, flexible insulator;

connecting each of the second plurality of circuit patterns on the separated portion to one of a plurality of conductors which are included in a second elongate, flexible flat cable and covered with a flat, flexible insulator;

connecting the first flat cable and the second flat cable to a first connector and a second connector, respectively, which are connected to the encoder circuit; and connecting contacts of the second plurality of key switches to the first circuit patterns and the second circuit patterns included in the separated portion.

9. The method in accordance with claim 8, further comprising:

mounting said second plurality of key switches on a generally rectangular, flat plate;

preparing four elongate frame members formed with slots identical in configuration with each other and each being expected to mate with a particular one of four sides of said flat plate over an entire length of said side;

causing the four sides of said flat plate and said four frame members to respectively mate with each other; and connecting said four frame members with four connecting members to thereby form a frame in a generally rectangular configuration, as seen in a plane.

10. The method in accordance with claim 8, further comprising mounting said second circuit board to said first circuit board.

11. The method in accordance with claim 8, said method further comprising writing a coding program matching with said plurality of key switches wherein said encoder includes a rewritable memory.

12. A method of producing a keyboard, comprising the steps of:

preparing a first circuit board having a first plurality of circuit patterns printed thereon to connect one terminals of contacts of a first plurality of key switches to be arranged in a matrix to each other in a first direction of the matrix, and a second plurality of circuit patterns printed thereon to connect other terminals of the contacts to each other in a second direction of the matrix, the first plurality of circuit patterns and the second plurality of circuit patterns intersecting each other;

preparing a desired, second plurality of key switches smaller in number than the first plurality of key switches;

slicing the first circuit board to separate a portion of the first circuit board corresponding to the second plurality of key switches;

preparing a second circuit board carrying thereon an encoder for generating code signals representative of statuses of the second plurality of key switches;

connecting each of the first plurality of circuit patterns on the separated portion to one of a plurality of conductors which are included in a first flat cable and covered with a flat, flexible insulator;

connecting each of the second plurality of circuit patterns on the separated portion to one of a plurality of conductors which are included in a second flat cable and covered with a flat, flexible insulator;

connecting the first flat cable and the second flat cable to a first connector and a second connector, respectively, which are connected to the encoder circuit;

connecting contacts of the second plurality of key switches to the first circuit patterns and the second circuit patterns included in the separated portion;

mounting said second plurality of key switches on a generally rectangular, flat plate;

preparing four elongate frame members formed with slots identical in configuration with each other and each being expected to mate with a particular one of four sides of said flat plate over an entire length of said side;

causing the four sides of said flat plate and said four frame members to respectively mate with each other; and connecting said four frame members with four connecting members to thereby form a frame in a generally rectangular configuration, as seen in a plane.

13. The method in accordance with claim 12, further comprising the step of mounting said second circuit board to said first circuit board.

14. The method in accordance with claim 12, wherein said encoder includes a rewritable memory, said method further comprising the step of writing a coding program matching with said plurality of key switches in said memory.

* * * * *